US010092157B2

(12) United States Patent
Yang et al.

(10) Patent No.: US 10,092,157 B2
(45) Date of Patent: Oct. 9, 2018

(54) ROBOT CLEANER

(71) Applicant: LG ELECTRONICS INC., Seoul (KR)

(72) Inventors: Haeseock Yang, Changwon-si (KR); Dongsuk Choi, Changwon-si (KR)

(73) Assignee: LG ELECTRONICS INC., Seoul (KR)

( * ) Notice: Subject to any disclaimer, the term of this patent is extended or adjusted under 35 U.S.C. 154(b) by 517 days.

(21) Appl. No.: 14/095,303

(22) Filed: Dec. 3, 2013

(65) Prior Publication Data

US 2014/0156075 A1 Jun. 5, 2014

(30) Foreign Application Priority Data

Dec. 4, 2012 (KR) ..... 10-2012-0139670

(51) Int. Cl.
*A47L 11/40* (2006.01)
*A47L 9/28* (2006.01)

(52) U.S. Cl.
CPC ..... *A47L 11/4011* (2013.01); *A47L 9/2857* (2013.01); *A47L 11/4002* (2013.01); *A47L 2201/00* (2013.01)

(58) Field of Classification Search
None
See application file for complete search history.

(56) References Cited

U.S. PATENT DOCUMENTS 5,701,355 A * 12/1997 Brannan ..... H04R 1/08 174/653
7,616,260 B2 * 11/2009 Kano ..... H04R 1/08 348/374
2004/0253944 A1 * 12/2004 Kelley ..... H04M 1/72575 455/418
2004/0262060 A1 12/2004 Kim
2005/0015912 A1 1/2005 Kim
2005/0183230 A1 8/2005 Uehigashi ..... 15/319
2010/0256812 A1 * 10/2010 Tsusaka ..... A47L 9/24 700/254
2012/0135787 A1 * 5/2012 Kusunoki ..... H04M 1/0214 455/575.8

FOREIGN PATENT DOCUMENTS

CN 2510249 Y 9/2002
CN 1876337 A 12/2006
CN 1297224 C 1/2007
CN 101084817 A 12/2007
(Continued)

OTHER PUBLICATIONS

European Search Report dated Mar. 13, 2014 issued in Application No. 13 195 284.8.

(Continued)

*Primary Examiner* — Joseph J Hail
*Assistant Examiner* — Brian D Keller
(74) *Attorney, Agent, or Firm* — KED & Associates, LLP

(57) ABSTRACT

A robot cleaner is provided. The robot cleaner includes a main body, a voice input unit installed on the main body and comprising a microphone, a cover member to cover the voice input unit, and a buffering member provided on one of the main body and the cover member and adjacent to the voice input unit.

10 Claims, 5 Drawing Sheets

(56) References Cited

FOREIGN PATENT DOCUMENTS

| | | | |
|---|---|---|---|
| CN | 201078002 | | 6/2008 |
| CN | 201234672 | | 5/2009 |
| CN | 201415729 | | 3/2010 |
| CN | 202379185 | U | 8/2012 |
| EP | 1 731 072 | A2 | 12/2006 |
| KR | 10-2012-0114670 | A | 10/2012 |

OTHER PUBLICATIONS

Chinese Office Action dated Sep. 30, 2015 issued in Application No. 201310647850.6.
Chinese Office Action dated May 31, 2016 issued in Application No. 201310647850.6.

* cited by examiner

PRIOR ART

ROBOT CLEANER

CROSS-REFERENCE TO RELATED APPLICATIONS

The present application claims priority under 35 U.S.C. 119 and 35 U.S.C. 365 to Korean Patent Application No. 10-2012-0139670 (filed on Dec. 4, 2012), which is hereby incorporated by reference in its entirety.

BACKGROUND

Generally, robot cleaners automatically run and suck dusts or foreign substances on a floor.

A user may input a command for operating a robot cleaner using a remote controller or may input the command for operating by using an input unit provided in the robot cleaner.

In methods of inputting the command described above, since it is necessary to directly operate a button or a remote controller, it is inconvenient.

Accordingly, recently, robot cleaners operated by receiving voices of users have been provided. Such robot cleaners may include a microphone for receiving a voice and a control unit controlling a corresponding robot cleaner in response to a received voice signal.

However, in case of general robot cleaners, since a microphone is exposed outward from a robot cleaner, not only voices of a user but also peripheral noises are inputted to the microphone in such a way that the control unit has a difficulty of clearly recognizing the voice. In addition, since a noise generated while the robot cleaner is operating is also inputted via the microphone, an error is most likely to occur in voice recognition.

SUMMARY

Embodiments provide robot cleaners.

In one embodiment, a robot cleaner includes a main body, a voice input unit installed on the main body and including a microphone, a cover member to cover the voice input unit, and a buffering member provided on one of the main body and the cover member and adjacent to the voice input unit.

In another embodiment, a robot cleaner includes a main body including a receiving portion, a microphone received in the receiving portion, a sealing member received in the receiving portion and covering the microphone, a cover member to cover the body, and a buffering member disposed between the main body and the cover member.

The details of one or more embodiments are set forth in the accompanying drawings and the description below. Other features will be apparent from the description and drawings, and from the claims.

DETAILED DESCRIPTION OF THE EMBODIMENTS

Reference will now be made in detail to the embodiments of the present disclosure, examples of which are illustrated in the accompanying drawings.

In the following detailed description of the preferred embodiments, reference is made to the accompanying drawings that form a part hereof, and in which is shown by way of illustration specific preferred embodiments in which the invention may be practiced. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the invention, the description may omit certain information known to those skilled in the art. The following detailed description is, therefore, not to be taken in a limiting sense.

Figure 1:
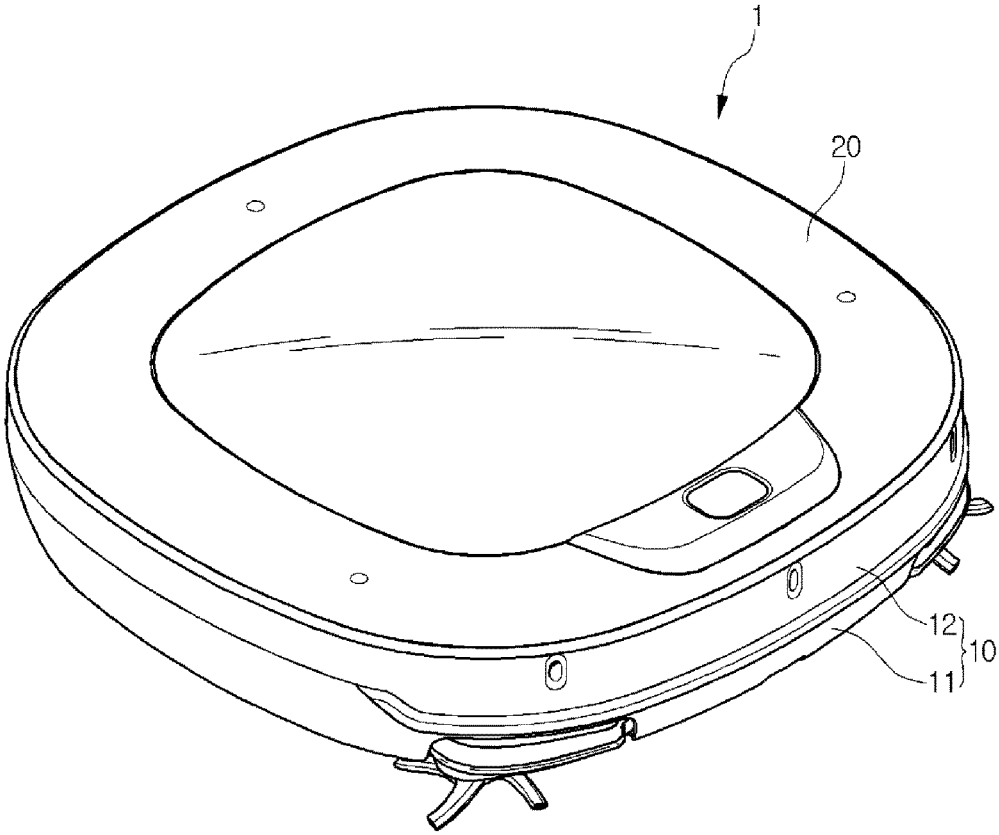
FIG. 1 is a perspective view illustrating a robot cleaner according to an embodiment of the present invention.
Figure 2:
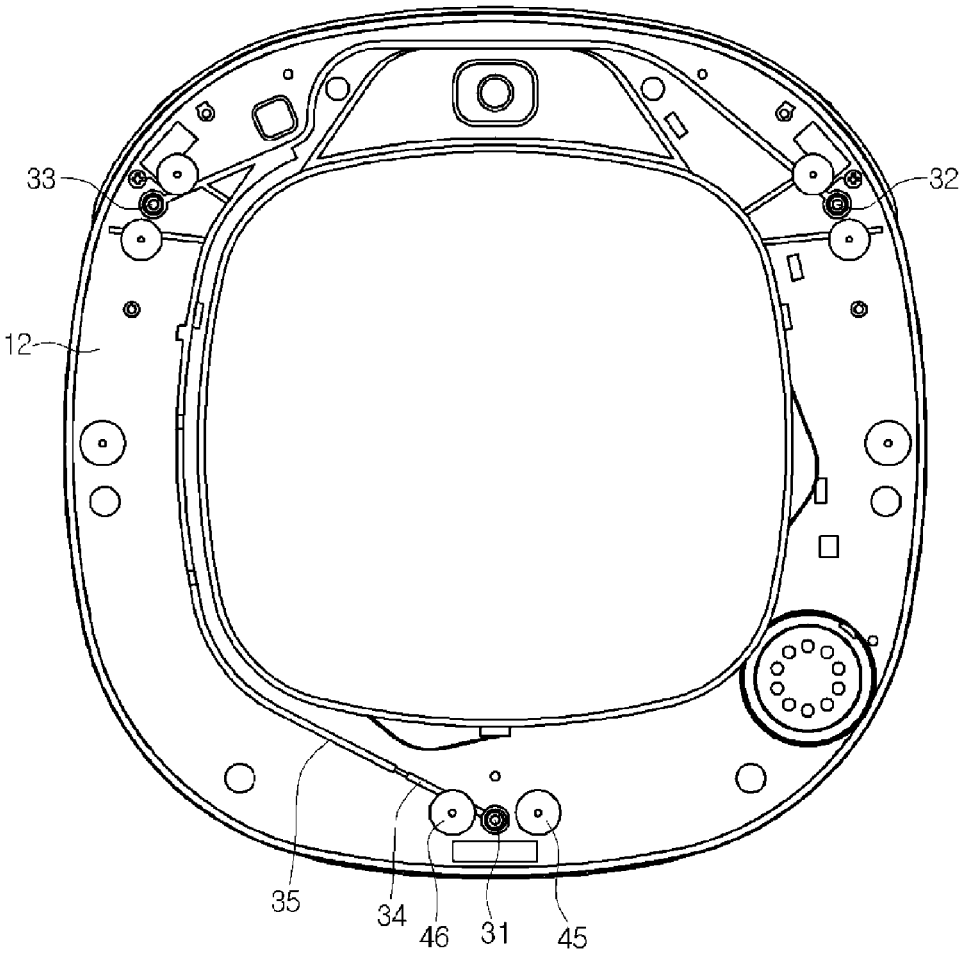
FIG. 2 is a top view illustrating a robot cleaner removed with an upper cover.

FIG. 1 is a perspective view illustrating a robot cleaner 1 according to an embodiment of the present invention, and FIG. 2 is a top view illustrating the robot cleaner 1 removed with an upper cover.

Referring to FIGS. 1 and 2, the robot cleaner 1 may include a main body 10 built with a motor for a transfer and a controller therein and a cover member 20 covering an upper side of the main body 10. The main body 10 may include a transfer device for transferring to the main body 10. The transfer device may include a plurality of wheels and a plurality of driving motors for rotating the plurality of wheels, respectively.

Figure 5:
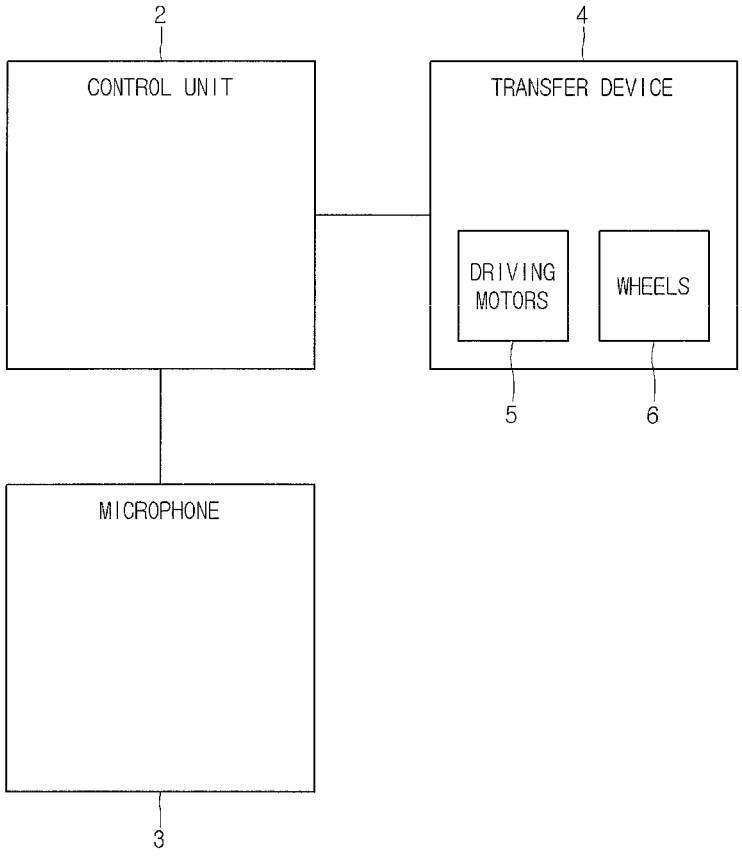
FIG. 5 is a block diagram of components of a robot cleaner.

Since the embodiment is substantially for a configuration for receiving a voice and other components of a robot cleaner may be embodied by well-known art, a detailed description thereof will be omitted. For example, FIG. 5 shows components of a prior art robot cleaner having voice command capabilities to operate by receiving voices of users. Such a robot cleaner may include a microphone 3 for receiving a voice command and a control unit 2 controlling a robot cleaner in response to a received voice signal. The control unit 2 may control a transfer device 4 based on the received voice signal. The transfer device 4 may include a plurality of wheels 6 and a plurality of driving motors 5 for rotating the plurality of wheels 6, respectively.

The main body 10 may include a base 11 and an upper body 12 combined with an upper side of the base 11. Also, a plurality of components may be received between the base 11 and the upper body 12.

The upper body 12 may include a plurality of microphones 31, 32, and 33 for receiving a voice. In FIG. 2, as an example, three microphones 31, 32, and 33 are included in the upper body 12 but the number of microphones is not limited thereto.

Also, on an inside of the main body 10 or an outer surface of the main body 10, a reference microphone (not shown) for receiving a sound generated inside while the robot cleaner 1 is operating may be further provided.

The control unit may recognize a voice command based on voice signals inputted from the reference microphone and the plurality of microphones 31, 32, and 33. In detail, the control unit, based on information inputted from the reference microphone, may remove noises from voice information inputted from the plurality of microphones 31, 32, and 33.

A virtual line connecting the three microphones 31, 32, and 33 may form a triangle. The upper body 12 may be formed with a wire receiving groove 35 receiving a wire 34 connected to the respective microphones 31, 32, and 33. According to the embodiment, the wire 34 is received in the wire receiving groove 35, thereby protecting the wire from being damaged and arranging neatly the wire 34.

The cover member 20 may cover an upper side of the upper body 12. While the cover member 20 is covering the upper body 12, the cover member 20 may cover the plurality of microphones 31, 32, and 33. Accordingly, the cover member 20 may be understood as forming an external shape of the robot cleaner 1 and additionally covering the plurality of microphones 31, 32, and 33.

The upper body 12 may include a plurality of buffering members 45 and 46. The buffering members 45 and 46 may be formed of any material that may absorb a shock.

The plurality of buffering members 45 and 46 is disposed adjacently to the respective microphones 31, 32, and 33. As an example, between the two buffering members 45 and 46, the respective microphones 31, 32, and 33 are located.

While the cover member 20 covers the upper body 12, a lower surface of the cover member 20 may be in contact with the plurality of buffering members 45 and 46. Otherwise, when the cover member 20 covers the upper body 12, the lower surface of the cover member 20 may be separated from the plurality of buffering members 45 and 46. When an external force is applied to the cover member 20, the cover member 20 is deformed in such a way that the lower surface of the cover member 20 may be in contact with the plurality of buffering members 45 and 46.

According to the embodiment, since the lower surface of the cover member 20 may be in contact with the plurality of buffering members 45 and 46, noises occurring due to tremors or vibrations of the cover member 20 may be prevented. When noises are generated by tremors of the cover member 20, since the noises are inputted to the respective microphones 31, 32, and 33, a recognition functions is deteriorated. However, according to the embodiment, since the plurality of buffering members 45 and 46 may be in contact with the cover member 20, the noises generated by the tremors of the cover member 20 may be prevented.

In this case, since the plurality of buffering members 45 and 46 are located adjacently to the respective microphones 31, 32, and 33, tremors of parts of the cover member 20 corresponding to the microphones 31, 32, and 33 are effectively prevented, thereby increasing a noise buffering effect.

In the embodiment, the plurality of buffering members 45 and 46 are provided on the upper body 12. However, differently, the plurality of buffering members 45 and 46 may be provided on the lower surface of the cover member 20. Also, the buffering members 45 and 46 may be provided on the cover member 20 and the upper body 12, respectively.

Also, in addition to the plurality of buffering members 45 and 46, as shown in FIG. 2, the main body 10 or the cover member 20 may include an additional buffering member.

In the above, the two buffering members 45 and 46 are provided on the periphery of the microphones 31, 32, and 33. However, one buffering member may be provided on the periphery of the microphones 31, 32, and 33. In this case, the one buffering member having a ring shape may be disposed to surround the periphery of the microphones 31, 32, and 33.

Figure 3:
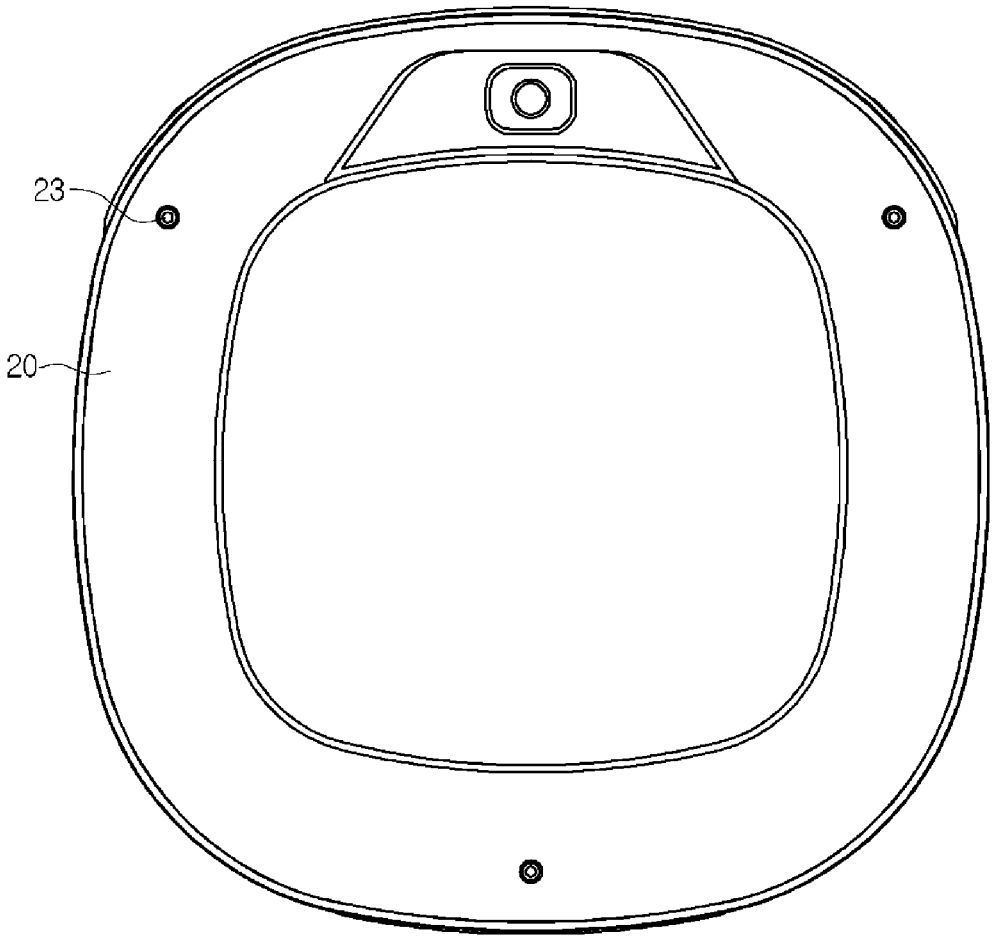
FIG. 3 is a bottom view illustrating a cover member according to an embodiment of the present invention.
Figure 4:
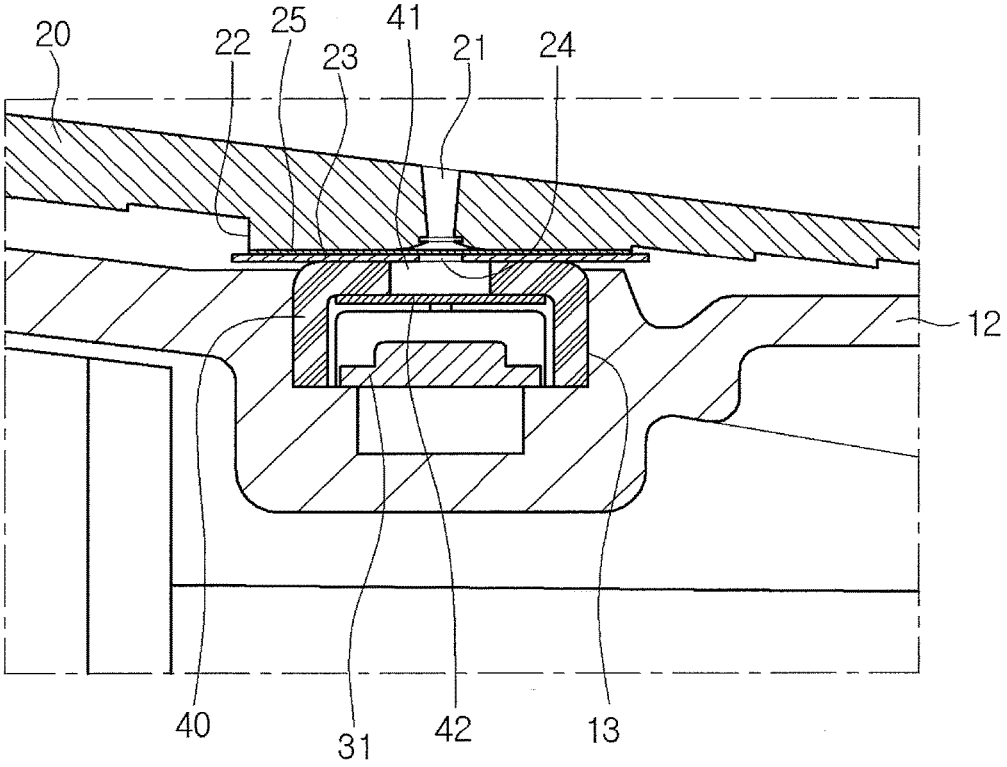
FIG. 4 is a cross-sectional view illustrating a microphone installation configuration according to an embodiment of the present invention.

FIG. 3 is a bottom view illustrating the cover member 20, and FIG. 4 is a cross-sectional view illustrating a microphone installation configuration according to an embodiment of the present invention.

Referring to FIGS. 3 and 4, on the lower surface of the cover member 20, a plurality of noise prevention portions 23 may be provided. The plurality of noise prevention portions 23 is located to be opposite to the respective microphones 31, 32, and 33 while the cover member 20 is being combined with the main body 10. Also, in a position corresponding to the noise prevention portion 23 of the cover member 20, a guide hole 21 guiding an external voice may be formed. Also, on the respective noise prevention portions 23, holes 24 allowing a voice passing through the guide hole to pass therethrough may be formed.

The cover member 20 may be round. Accordingly, when installing the noise prevention portion 23, to allow the noise prevention portion 23 to maintain level, on the lower surface of the cover member 20, an installation portion 22 may protrude downwardly. In this case, since the cover member 20 is round, a protrusion length of the installation portion 22 may vary with a position of the cover member 20. Also, a lower surface of the installation portion 22 is a flat surface and is horizontal.

Also, the noise prevention portion 23 may be installed on the installation portion 22. On the cover member 20, a waterproof film 25 for preventing an inflow of external foreign substances or water into the robot cleaner 1 through the guide hole 21 may be provided. The waterproof film 25 allows a voice to pass and blocks water or foreign substances.

The waterproof film 25, for example, may be provided between the installation portion 22 and the noise prevention portion 23, may be attached to an upper surface of the cover member 20 to cover the guide hole 21, or may be attached to a lower surface of the noise prevention portion 23.

On the other hand, on the main body 10, in detail, on the upper body 12, receiving portions 13 for receiving the microphones 31, 32, and 33, respectively, may be formed. The receiving portion 13, for example, may be a groove dented downwardly from the upper body 12. The microphones 31, 32, and 33 may be mounted on bottom surfaces of the receiving portions 13, respectively.

The microphones 31, 32, and 33 mounted on the receiving portions 13 may be covered by sealing members 40, respectively. The sealing members 40 are formed with spaces for receiving the microphones 31, 32, and 33 and holes 41 for allowing a voice to pass through on upper surfaces thereof.

The sealing member 40 may be mounted on the bottom surface of the receiving portion 13 and may be formed of, for example, rubber. Merely, in the embodiment, a material of the sealing member 40 is not limited thereto.

Accordingly, since supporting the sealing members 40 and the microphones 31, 32, and 33, the bottom surfaces of the receiving portions 13 may be designated as supporting portions.

The microphones 31, 32, and 33 are closely attached to inner circumferences of the sealing members 40 while being received in the sealing members 40. Accordingly, due to the sealing members 40, horizontal movements of the microphones 31, 32, and 33 may be prevented, respectively.

On an inside of the sealing member 40, a filter 42 for removing a noise from an inputted voice may be provided. The filter 42, for example, may be nonwoven fabrics, but in the embodiment, is not limited thereto.

While the sealing member 40 is being received in the receiving portion 13, a part of the sealing member 40 may protrude upwardly from the upper body 12. The sealing member 40 protrudes upwardly from the upper body 12 in order to be closely attached to the noise prevention portion 23 while the cover member 20 is being combined with the main body 10.

According to the embodiment, the sealing member 40 is closely attached to the noise prevention portion 23 while the cover member 20 is being combined with the main body 10, thereby preventing a gap formed between the sealing member 40 and the noise prevention portion 23. Accordingly, it may be prevented that noises occurring from a space between the cover member 20 and the main body 10 are inputted to the microphones 31, 32, and 33.

When the cover member 20 is combined with the main body 10, the guide hole 21 of the cover member 20, the hole 24 of the noise prevention portion 23, and the hole 41 of the sealing member 40 are arranged up and down.

Accordingly, the guide hole 21 and the holes 24 and 41 may function as a path for transferring a voice.

In the embodiment, the sealing members 40, the microphones 31, 32, and 33, and the filters 42 may be commonly designated as voice input units. Merely, the filters 42 may be omitted in the voice input units.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A robot cleaner comprising:

a main body;

a voice input unit installed on the main body and including a microphone;

a controller provided within the main body and configured to recognize a voice command;

a transfer device that moves the main body, the transfer device including a plurality of wheels and a plurality of drivers that rotate the plurality of wheels, respectively;

a cover member to cover the voice input unit;

a plurality of buffering members provided on one of the main body and the cover member and adjacent to the voice input unit, the plurality of buffering members being formed of a material that absorbs shock, wherein the voice input unit is located in an area between the plurality of buffering members, wherein the cover member is provided with a guide hole and a noise prevention portion formed with a hole vertically aligned with the guide hole to overlap each other, the noise prevention portion is provided at a lower surface of the cover member, and when the cover member is coupled to the main body, the noise prevention portion is in contact with the voice input unit, wherein the cover member is provided with an installation portion to allow the noise prevention portion to be installed, wherein the installation portion is integrally formed with the cover member, wherein the installation portion is protruded from a lower surface of the cover member, and the guide hole passes through the installation portion, wherein a lower surface of the installation portion is a flat surface, and wherein the cover member is provided with a waterproof film that prevents an inflow of external foreign substances or water through the guide hole, the waterproof film being provided in a space between the installation portion and the noise prevention portion.

2. The robot cleaner of claim 1, wherein when the cover member is coupled to the main body, the cover member is in contact with the plurality of buffering members.

3. The robot cleaner of claim 1, further comprising an additional buffering member spaced apart from the plurality of buffering members.

4. The robot cleaner of claim 1, wherein the main body includes a receiving portion to receive the voice input unit, the voice input unit further includes a sealing member to cover the microphone, and the sealing member and the microphone are supported by a bottom surface of the receiving portion.

5. The robot cleaner of claim 4, wherein while the sealing member is being received in the receiving portion, the sealing member protrudes upwardly from the main body.

6. The robot cleaner of claim 4, wherein the sealing member is provided with a hole to guide sound, and the hole of the sealing member and the microphone are vertically aligned to overlap each other.

7. The robot cleaner of claim 4, wherein a filter to remove noises is provided in the sealing member.

8. A robot cleaner comprising:

a main body having a receiving portion;

a microphone contained in the receiving portion;

a controller provided within the main body and configured to recognize a voice command inputted to the microphone;

a transfer device that moves the main body, the transfer device including a plurality of wheels and a plurality of drivers to rotate the plurality of wheels, respectively;

a sealing member that is received in the receiving portion and that covers the microphone;

a cover member to cover the main body;

a plurality of buffering members formed of a material that absorbs shock, and provided between the main body and the cover member, wherein the microphone is located in an area between the plurality of buffering members, wherein a noise prevention portion is mounted on the sealing member, wherein the cover member, the sealing member and the noise prevention portion are each provided with a hole, the hole of the cover member, the hole of the sealing member and the hole of the noise prevention portion being vertically aligned to overlap each other, wherein the hole of the sealing member and the microphone are vertically aligned to overlap each other, wherein the cover member is provided with an installation portion to allow the noise prevention portion to be installed, wherein the installation portion is integrally formed with the cover member, wherein a lower surface of the installation portion is a flat surface, and wherein the cover member is provided with a waterproof film that prevents an inflow of external foreign substances or water through the guide hole, the waterproof film being provided in a space between the installation portion and the noise prevention portion.

9. The robot cleaner of claim 8, wherein a filter to remove noises is provided between the hole of the sealing member and the microphone.

10. The robot cleaner of claim 8, wherein the sealing member protrudes upwardly from the body while being mounted on the receiving portion.

* * * * *